US008411893B2

(12) United States Patent
Ito et al.

(10) Patent No.: US 8,411,893 B2
(45) Date of Patent: Apr. 2, 2013

(54) HEADPHONE

(75) Inventors: Tomohiro Ito, Tokyo (JP); Tomohiro Matsuo, Tokyo (JP)

(73) Assignee: Sony Corporation, Tokyo (JP)

( * ) Notice: Subject to any disclaimer, the term of this patent is extended or adjusted under 35 U.S.C. 154(b) by 530 days.

(21) Appl. No.: 12/354,138

(22) Filed: Jan. 15, 2009

(65) Prior Publication Data

US 2009/0185706 A1 Jul. 23, 2009

(30) Foreign Application Priority Data

Jan. 17, 2008 (JP) ..... 2008-007973

(51) Int. Cl.
*H04R 25/02* (2006.01)

(52) U.S. Cl. ..... 381/381; 381/379; 381/382; 181/135

(58) Field of Classification Search ..... 381/378, 381/379, 381, 382, 383; 181/130, 135
See application file for complete search history.

(56) References Cited

U.S. PATENT DOCUMENTS

| | | | | |
|---|---|---|---|---|
| 5,327,178 | A * | 7/1994 | McManigal | 351/158 |
| 5,457,751 | A * | 10/1995 | Such | 381/375 |
| 5,506,911 | A * | 4/1996 | Neuman et al. | 381/381 |
| 5,729,615 | A * | 3/1998 | Yang | 381/370 |
| 6,176,576 | B1 * | 1/2001 | Green et al. | 351/123 |
| 6,490,362 | B1 * | 12/2002 | Clegg et al. | 381/375 |
| 6,603,863 | B1 * | 8/2003 | Nagayoshi | 381/380 |
| 6,690,807 | B1 * | 2/2004 | Meyer | 381/327 |
| 6,721,433 | B2 * | 4/2004 | Sato | 381/379 |
| 2002/0168081 | A1 * | 11/2002 | Sato | 381/379 |
| 2004/0170294 | A1 | 9/2004 | Murozaki et al. | |
| 2005/0208980 | A1 | 9/2005 | Tsai et al. | |
| 2006/0291686 | A1 * | 12/2006 | Hlas et al. | 381/381 |
| 2007/0003093 | A1 | 1/2007 | Ito et al. | |
| 2007/0104345 | A1 * | 5/2007 | Yang | 381/381 |

FOREIGN PATENT DOCUMENTS

| | | |
|---|---|---|
| EP | 1 809 069 A1 | 7/2007 |
| EP | 2 071 867 A1 | 6/2009 |
| JP | 63-113392 | 7/1988 |
| JP | 9-307983 | 11/1997 |
| JP | 2001-189982 | 7/2001 |

(Continued)

OTHER PUBLICATIONS

English translation of JP2006-005583.*

(Continued)

*Primary Examiner* — Jeremy Luks
(74) *Attorney, Agent, or Firm* — Finnegan, Henderson, Farabow, Garrett & Dunner, L.L.P.

(57) ABSTRACT

There is provided a headphone including: a housing that accommodates a driver unit; a sound guiding tube that protrudes from the housing in a predetermined direction and guides a sound generated from the driver unit to an external auditory canal; and a hanger that rotatably supports the housing via a supporting shaft provided in approximately the same direction as a depth direction of the external auditory canal and in a direction inclined to a protruding direction of the sound guiding tube. According to this structure, by rotating the housing with respect to the hanger via the supporting shaft, the protruding direction of the sound guiding tube with respect to the hanger can be adjusted. Thus, by adjusting the protruding direction of the sound guiding tube according to the inclined angle of the external auditory canal of a user, wearability of a headphone can be improved.

7 Claims, 7 Drawing Sheets

FOREIGN PATENT DOCUMENTS

| | | |
|---|---|---|
| JP | 2003-143680 | 5/2003 |
| JP | 2006-5583 | 1/2006 |
| JP | 2006-94006 | 4/2006 |
| JP | 2007-13873 | 1/2007 |
| JP | 2007-189468 | 7/2007 |
| WO | WO 2007/022634 A1 | 3/2007 |

OTHER PUBLICATIONS

Notification of Reasons for Refusal of Japanese Patent Application No. JP 2008-007973, (Dec. 11, 2009).
Extended European Search Report for Application No. 09250013.1, Sep. 9, 1012, (6 pages).

* cited by examiner

HEADPHONE

CROSS REFERENCES TO RELATED APPLICATIONS

The present invention contains subject matter related to Japanese Patent Application JP 2008-7973 filed in the Japan Patent Office on Jan. 17, 2008, the entire contents of which being incorporated herein by reference.

BACKGROUND OF THE INVENTION

1. Field of the Invention

The present invention relates to a headphone.

2. Description of the Related Art

In recent years, a custom to listen to music at any time and place has been spread, particularly among young people. Accordingly, from the viewpoint of preventing leakage of sound to a surrounding area and improving acoustic characteristics, a headphone designed to be worn by inserting a sound guiding tube into an external auditory canal has been greatly demanded.

According to this kind of headphone, a housing accommodating a driver unit is supported by end parts of such as a band and a hanger. For example, this kind of headphone is used in a state that the band is fitted to a side head part, a top head part, and a rear head part of a user, or the hanger is fitted to an auricle of the user. Then, the headphone is used in a state that the band and the hanger are fitted to the user, and the sound guiding tube protruded from the housing is inserted into the external auditory canal.

Also, by forming an elastic earpiece on a tip end of the sound guiding tube, wearability is improved, and by maintaining air-tightness against the external auditory canal, the leakage of sound to the surrounding area is prevented, and the acoustic characteristics are improved.

The external auditory canal into which the sound guiding tube is inserted is inclined toward a depth direction (direction of an eardrum), when a front side of the auricle is set as a reference. For this reason, the sound guiding tube is protruded from the housing so as to have a predetermined inclined angle with respect to a front face of the auricle, in a state of wearing the band and the hanger by a user.

For example, the invention described in the following patent document is given as a technique in related art for improving the wearability of the headphone.

Japanese Patent Application Laid-Open No. 2001-189982 discloses a headphone wherein right and left housings can be moved on both ends of the band so as to correspond to a position of the auricle of the user.

Japanese Patent Laid Open No. 2003-143680 discloses a technique in which a support member for supporting the housing is provided on one end of a bent part of a guide, and a pressing part is provided on the other end for elastically pressing the backside of the auricle of the user toward the housing, and a diaphragm in the housing is disposed almost vertically to a surface constituted by the bent part of the guide, at the face side of the user.

Japanese Patent Application Laid-Open No. 2006-94006 discloses a headphone unit including a housing and a support member for supporting the housing formed to be a curved shape for ear hanging purpose, is provided with a soft flexible member the one end of which is fixed to the support member and the other end of which is freely slidably fitted to the support member, and the distance between the center of the housing and the flexible member is adjusted by sliding the other end of the flexible member with respect to the support member.

Japanese Patent Application Laid-Open No. 2007-13873 discloses a headphone including: an approximately U-shaped band part of which one end and the other end are held on a side head part near upper ends of left and right ears of a user who wears the headphone on the head and of which an intermediate part is positioned in a rear head part of the user; left and right linking members connected to the band part; and left and right housings linked by the linking members in the state of being hung down from the band parts.

SUMMARY OF THE INVENTION

However, there is an individual difference in an inclined angle in each direction of depth, upper/lower and right/left directions of an external auditory canal. Therefore, the wearability of the headphone is deteriorated depending on the shape and size of a head part and ear auricle of a user and particularly inclined angle of the external auditory canal, and air-tightness against the external auditory canal can hardly be maintained in some cases.

In addition, the above patent documents do not disclose a technique for improving the wearability according to the inclined angle of the external auditory canal of the user, but only disclose a technique for improving the wearability of the headphone.

It is desirable to provide a headphone, capable of improving the wearability according to the inclined angle of the external auditory canal of the user.

According to an embodiment of the present invention, there is provided a headphone including: a housing that accommodates a driver unit; a sound guiding tube that guides a sound generated from the driver unit to an external auditory canal; and a hanger that rotatably supports the housing via a supporting shaft provided approximately in the same direction as a depth direction of the external auditory canal and in a direction inclined with respect to a protruding direction of the sound guiding tube. Note that the above headphone may also include an earpiece attached to the tip end of the sound guiding tube.

According to this structure, by rotating the housing relatively to the hanger via the supporting shaft, the protruding direction of the sound guiding tube with respect to the hanger can be adjusted. Thus, by adjusting the protruding direction of the sound guiding tube according the inclined angle of the external auditory canal of the user, the wearability of the headphone can be improved.

In addition, the housing may be supported rotatably to the hanger via the supporting shaft so as to be movable, by setting the protruding direction of the sound guiding tube in a range of 0° to ±40°, particularly in a range of 0° to 40° in an elevation angle direction, with a horizontal face as a reference in a wearing state. Thus, the protruding direction of the sound guiding tube can be adjusted, so as to correspond to the inclined angle of the external auditory canal in a case of an ordinary user.

Further, the above supporting shaft may be a screw member. Thus, rotation of the housing with respect to the hanger can be realized with a simple structure, and therefore the headphone easy to reduce in size and weight can be realized.

In addition, a rotation angle of the housing with respect to the hanger can be regulated through ribs provided to the housing and the hanger. Thus, the rotation angle of the housing with respect to the hanger can be regulated with a simple structure, and therefore the headphone easy to reduce in size and weight can be realized.

According to the embodiments of the present invention described above, there is provided a headphone capable of improving a wearability according to an inclined angle of an external auditory canal of a user.

DETAILED DESCRIPTION OF THE PREFERRED EMBODIMENTS

Figure 1B:
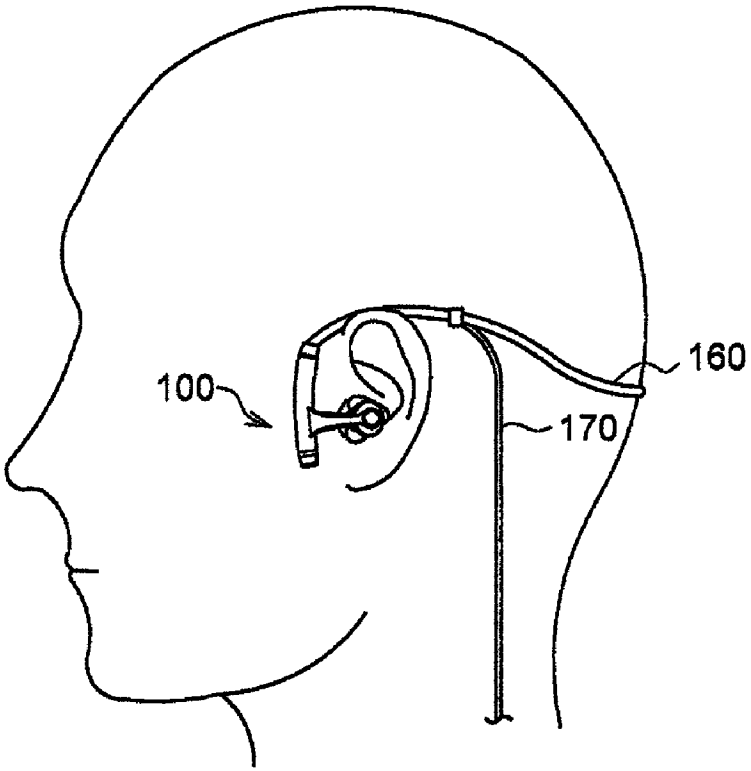
FIG. 1B is an explanatory view illustrating the wearing state of the headphone according to an embodiment of the present invention.

Hereinafter, preferred embodiments of the present invention will be described in detail with reference to the appended drawings. Note that, in the specification and the appended drawings, structural elements that have substantially the same function and structure are denoted with the same reference numerals, and repeated explanation of these structural elements is omitted.

Figure 1A:
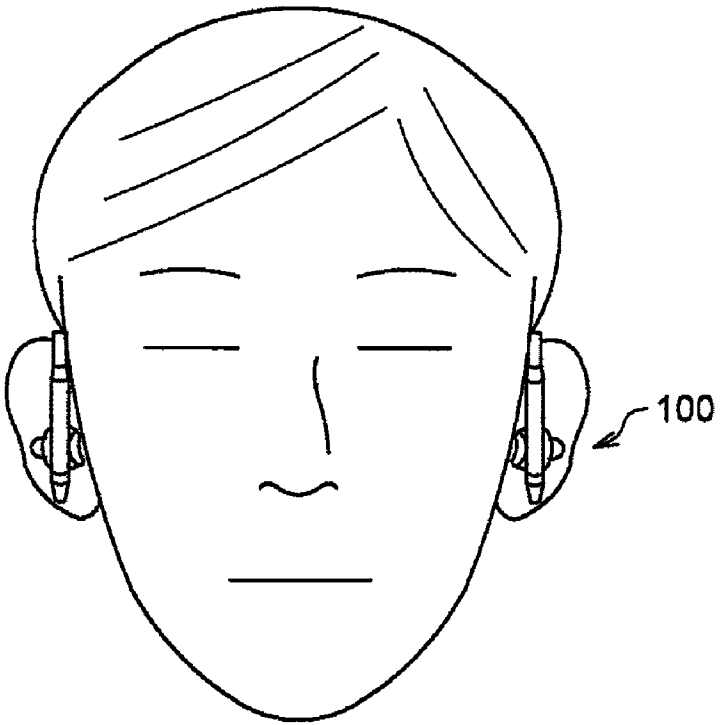
FIG. 1A is an explanatory view illustrating a wearing state of a headphone according to an embodiment of the present invention.

FIG. 1A and FIG. 1B are explanatory views illustrating a wearing state of a headphone 100 according to an embodiment of the present invention. FIG. 1A and FIG. 1B illustrate a wearing state of a headphone 100, when a user wearing the headphone 100 is viewed from a front side, and a wearing state of the headphone 100 when the user wearing the headphone 100 is viewed from the left side, respectively. FIG. 1A and FIG. 1B illustrate a head band type headphone 100 designed so that a band (headband 160) is passed over a rear head part.

Description will be given hereunder, mainly for a case in which the present invention is applied to the headphone 100 of a type shown in FIG. 1A and FIG. 1B. However, the present invention is not limited to the headphone of the type shown in FIG. 1A and FIG. 1B, and can be applied to the headphone of a type such as a headband type in which the band is passed over a head top part, a neckband type, and an under chin band type, and also can be similarly applied to a headset. Further, the present invention is not limited to the band type, and can be similarly applied to the headphone of a hanger type having a hanger that can be hung on an auricle, or can be similarly applied to the headset.

As illustrated in FIG. 1A and FIG. 1B, the headphone 100 has a headband 160 having right and left pair of headphone units (also called "units" hereafter) attached to both ends. In the headphone 100, a code 170 connecting a pair of units is made integral with the headband 160, and is led out from one of the units (corresponding to a left side unit in FIG. 1A and FIG. 1B) as a code 170 with plug.

Figure 2:
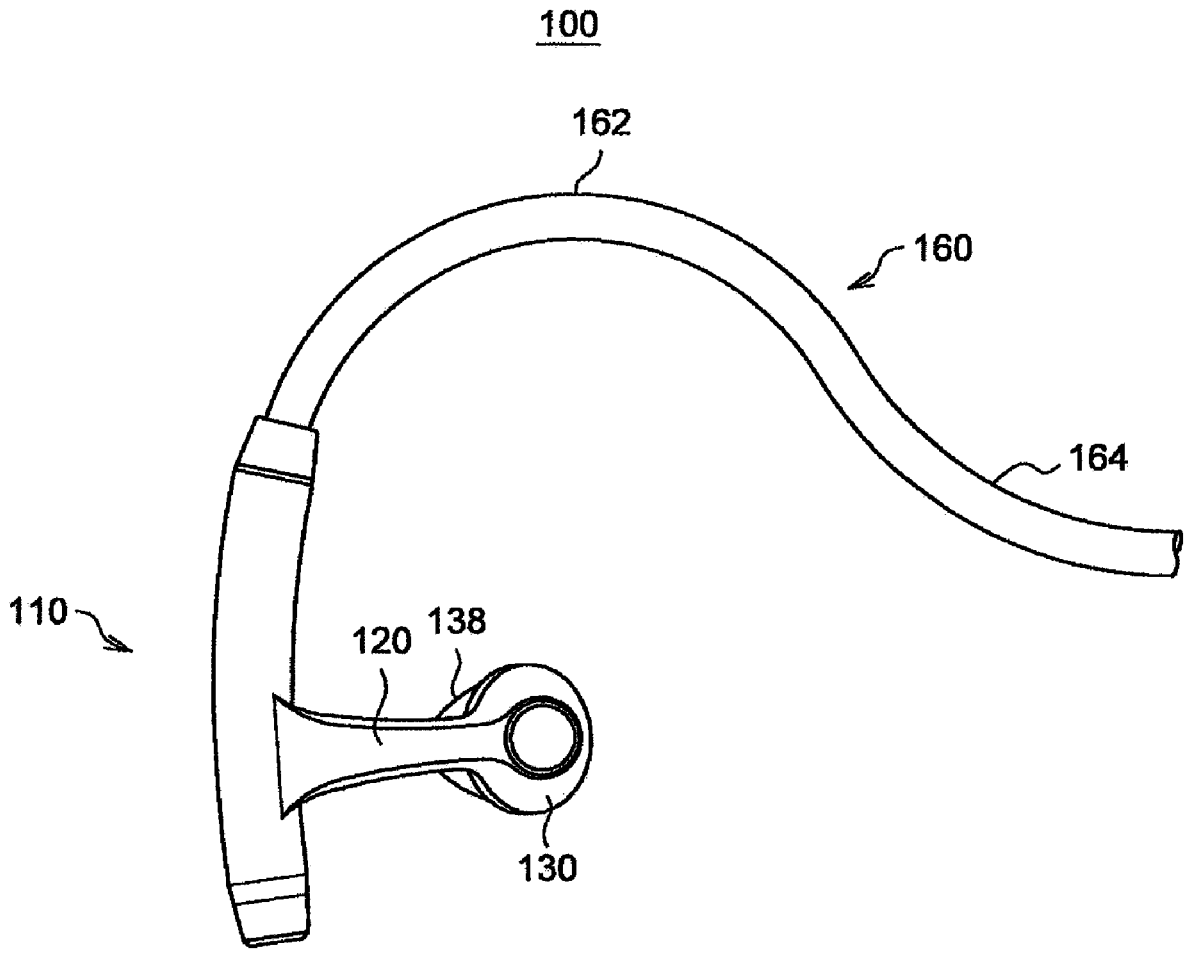
FIG. 2 is an explanatory view illustrating an appearance of the headphone according to an embodiment of the present invention.

FIG. 2 is an explanatory view illustrating an appearance of the headphone 100 according to this embodiment. Note that although FIG. 2 illustrates only a left side unit, a right side unit and the left side unit are set in mirror symmetry, excluding a part of the code 170 with plug. In FIG. 2, display of the code 170 with plug is omitted.

As illustrated in FIG. 2, the headphone 100 is constituted of a pair of units and the headband 160 having the pair of units attached to the both ends. Each unit has an approximately cylindrical hanger 110, to which the headband 160 is attached, so as to be hung on the auricle of the user in a curve state along the rear head part of the user.

The hanger 110 is formed so that an arm part 120 of a predetermined length is provided at a predetermined position of a lower part so as to protrude in an auricle direction, and the hanger 110 is positioned at a face side of the user with respect to the auricle when the headphone 100 is worn. In addition, the hanger 110 is formed so that a housing (rear housing) 130 for accommodating a driver unit 132 is attached to the tip end of the arm part 120, and an elastic earpiece 138 is attached to the tip end of a part of a sound guiding tube 136 (corresponding to a part of a front housing 134) protruded in a predetermined direction from the housing 130 (see FIG. 3).

Also, the hanger 110 is formed so that an ear hanging part 162 of the headband 160, which is curved along the shape of an upper part of the auricle, is attached to the upper end of the hanger 110. In addition, the hanger 110 is formed so as to hold the ear hanging part 162 of the headband 160, with the earpiece 138 inserted into the external auditory canal, and so that the hanger 110 itself is not hung on the auricle of the user.

The headband 160 is formed in such a manner that a circular arcuate shaped ear hanging part 162 is hung on the auricle, and other part 164 is held along the rear head part. Here, the headband 160 is constituted in such a manner that an elastic wire 166 (not shown) curved along the shape of the ear hanging part 162 and the shape of the rear head part is inserted inside, and the shape of the headband 160 is not easily deformed when the headphone 100 is worn. Note that an elastic body composed of synthetic resin such as polypropylene (PP) and polybutylene terephthalate (PBP) is used in an outer surface of the headband 160.

Figure 3:
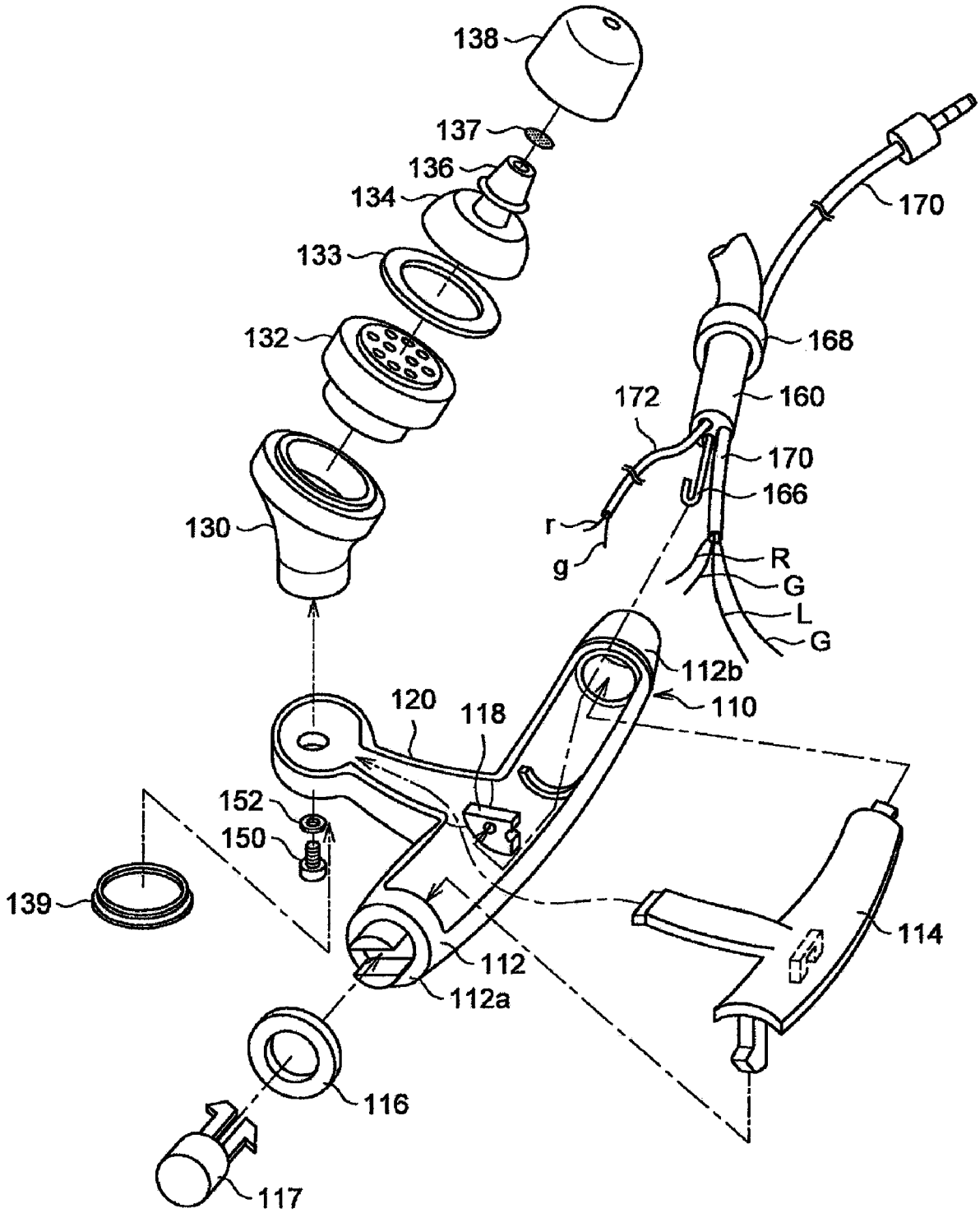
FIG. 3 is an explanatory view illustrating details of a hanger in particular out of constituent elements of a unit.

FIG. 3 is an explanatory view illustrating details of the hanger 110 in particular out of the constituent elements of the unit. FIG. 3 illustrates an exploded perspective view of the constituent elements of the unit.

As illustrated in FIG. 3, the hanger 110 is formed into approximately the same T-shape as a casing 112 having approximately the T-shape, with which a slightly smaller lid member 114 is engaged through a claw part, so as to be made integral with an arm part 120. Also, in the hanger 110, an end cap 117 is attached to a lower end 112*a* of the casing 112 through a decorative ring 116.

Also, in the hanger 110, the housing 130 for accommodating the driver unit 132 is attached to the tip end of the arm 120 by a male screw 150 through a washer 152. Here, although described later, the male screw 150 is provided in approximately the same direction as the depth direction of the external auditory canal and in a direction inclined to the protruding direction of the sound guiding tube 136, and functions as a supporting shaft for supporting the housing 130 to the hanger 110.

Also, in the housing 130, an earpiece 138 is attached to the tip end of the sound guiding tube 136 through a driver unit 132, a register 133, a front housing 134, and an equalizer 137. Further, in the hanger 110, a decorative cap 139 is fitted with the tip end of the arm part 120 in the reverse direction to the housing 130.

The headband 160 and the code 170 are inserted through the hanger 110, via a through hole of an upper end 112*b* of the casing 112, and an end part of an elastic wire 166 internally inserted through the headband 160 is engaged with an engaging part 118 of the casing 112, thereby attaching the headband 160 to the casing 112. As described above, the elastic wire 166 is internally inserted through the headband 160 in a state of being curved along the shape of the ear hanging part 162 and the shape of other part 164 along the rear head part, and approximately circular arcuate ear hanging part 162 is hung on the auricle when the headphone 100 is worn, so that the shape of the headband 160 is not easily deformed in this state.

A core wire L and a ground wire G for a left channel in the code 170 are connected to the driver unit 132 through the arm part 120 of the casing 112. Also, a core wire r and a ground wire g for a right channel in the code 170 are folded back in the casing 112, and are connected to the core wire r and the ground wire g for the right channel of a crossover code 172 for connecting to the driver unit (not shown) of a right side unit. Note that the code 170 is made integral with the headband 160, with a branching point from the headband 160 set in a movable state by making an attaching slider 168 slide along the headband 160.

Figure 4B:
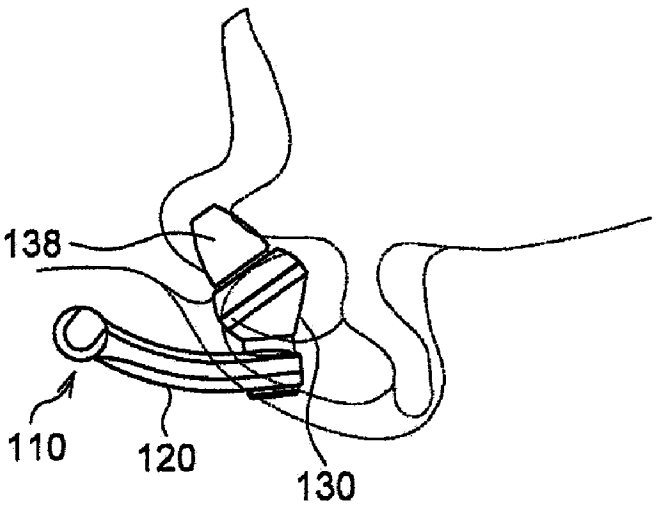
FIG. 4B is an explanatory view illustrating the wearing state of the headphone in detail.
Figure 4A:
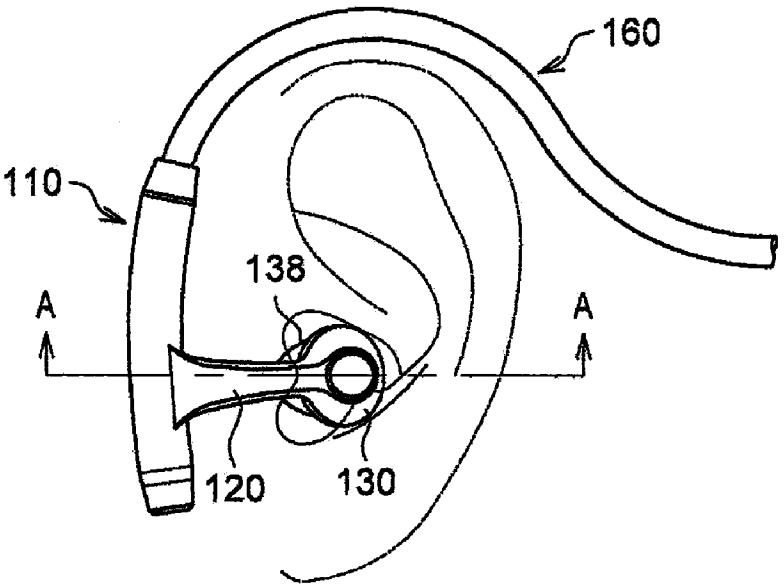
FIG. 4A is an explanatory view illustrating a wearing state of the headphone in detail.

FIG. 4A and FIG. 4B are explanatory views illustrating a wearing state of the headphone 100 in detail. FIG. 4A and FIG. 4B are a front view of the auricle on which the headphone 100 is worn, and a sectional view of the auricle taken along the line A-A, respectively.

As illustrated in FIG. 4A and FIG. 4B, the headphone 100 is worn by the user, so that the ear hanging part 162 of the headband 160 is held by the hanger 110, in a state that the earpiece 138 attached to the tip end of the sound guiding tube 136 is inserted into the external auditory canal.

As described above, the external auditory canal into which the sound guiding tube 136 is inserted via the earpiece 138 is inclined toward the depth direction (direction of eardrum), when the front surface of the auricle is set as a reference. Therefore, the sound guiding tube 136 is protruded from the housing 130 so as to have a predetermined inclined angle with respect to the front surface of the auricle when the headphone 100 is worn, and the elastic earpiece 138 is attached to the tip end. Here, the protruding direction of the sound guiding tube 136 is set so as to be adapted to the inclined angle of an external auditory canal of an ordinary user. Thus, the wearability of the headphone 100 and the air tightness against the external auditory canal are ensured.

However, there is an individual difference in the inclined angle in the depth direction and upper/lower and right/left directions of the external auditory canal. Therefore, the wearability of the headphone 100 is deteriorated, depending on the shape and the size of the head part and the auricle of the user and particularly the inclined angle of the external auditory canal, and the air tightness against the external auditory canal can hardly be maintained in some cases. Therefore, the headphone 100 according to this embodiment improves the wearability by having the adjustment mechanism for adjusting the protruding direction of the sound guiding tube 136 according to the inclined angle of the external auditory canal of the user.

Figure 5A:
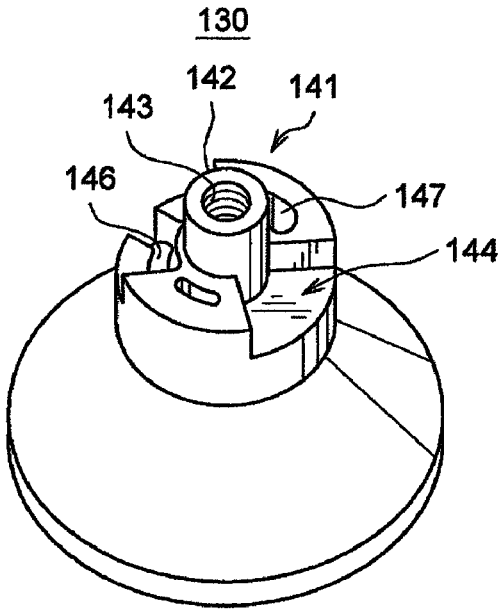
FIG. 5A is an explanatory view illustrating an adjustment mechanism for adjusting a protruding direction of a sound guiding tube.
Figure 5B:
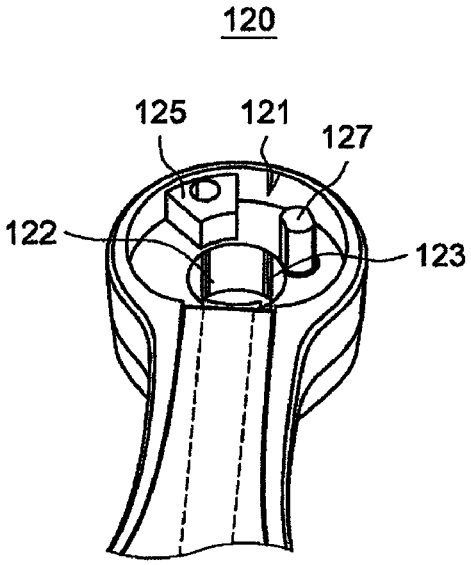
FIG. 5B is an explanatory view illustrating the adjustment mechanism for adjusting the protruding direction of the sound guiding tube.
Figure 5C:
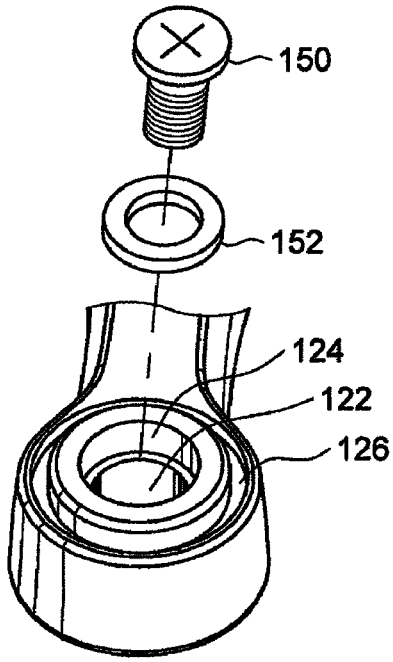
FIG. 5C is an explanatory view illustrating the adjustment mechanism for adjusting the protruding direction of the sound guiding tube.
Figure 6:
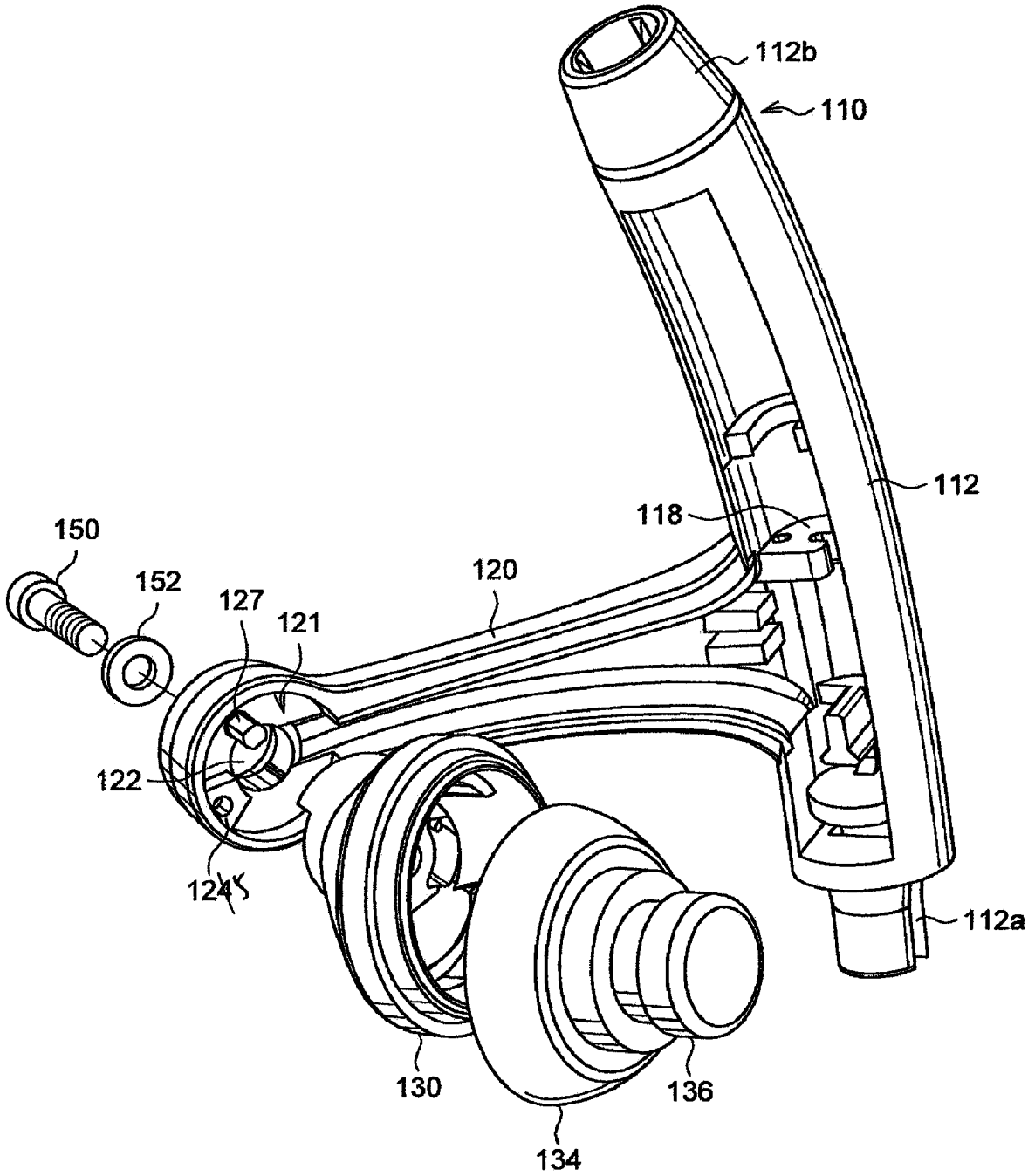
FIG. 6 is an explanatory view illustrating an assembly state of a hanger and a housing.

FIG. 5A, FIG. 5B, FIG. 5C are explanatory views illustrating the adjustment mechanism for adjusting the protruding direction of the sound guiding tube 136. FIG. 5A, FIG. 5B, and FIG. 5C illustrate a lower surface of the housing 130, a tip end upper surface of the arm part 120 of the hanger 110, and a tip end lower surface of the arm part 120, respectively. Also, FIG. 6 is an explanatory view illustrating the assembly state of the hanger 110 and the housing 130.

As illustrated in FIG. 5A, an approximately cylindrical connection part 141 protruded toward the arm part 120 is provided on the lower surface (connection surface with the arm part 120) of the housing (rear housing) 130.

A convex connection part 142 is provided in the center of the connection part 141, having an annular sectional face with a male screw 143 provided along the inner peripheral surface, and fitted with a concave connection part 122 of a connected part 121 provided at the tip end of the arm part 120.

On the periphery of the convex connection part 142, there is provided a code through hole 146 into which the code 170 is inserted so as to be laid from the hanger 110 to the driver unit 132. The code through hole 146 is formed as an oblong groove having a space for preventing twist, to prevent the twist of the code 170 that occurs during rotation of the housing 130 with respect to the hanger 110. On the periphery of the convex connection part 142, a fan-shaped concave rib 144 is provided for regulating the rotation angle of the housing 130 with respect to the hanger 110.

As illustrated in FIG. 5B and FIG. 5C, in the tip end of the arm part 120, the connected part 121 having an internal cross section with slightly larger inner diameter than an outer diameter of the connection part 141 of the housing 130 is provided on an upper surface (connection surface with the housing 130). In addition, on the tip end of the arm part 120, a washer concave part 124 having a circular internal cross section and a fitting groove 126, with which a decorative cap 139 is fitted, are provided on a lower surface (opposite surface to the connection surface with the housing 130).

In the center of the connected part 121, there is provided the concave connection part 122 having the internal cross section with slightly larger inner diameter than the outer diameter of a convex connection part 142 of the housing 130 in such a manner as communicating with the washer concave part 124 to pass through the tip end of the arm part 120. In addition, in order to suppress a frictional sound (bird call) that occurs between the convex connection part 142 and the concave connection part 122 during rotation of the housing 130 with respect to the hanger 110, semicircular ribs 123 are provided in several places on the inner peripheral surface of the concave connection part 122.

There is provided a fan-shaped rib 125 on the periphery of the concave connection part 122, for regulating the rotation angle of the housing 130 with respect to the hanger 110 by engaging with a concave-shaped rib 144 of the housing 130. Also, in the periphery of the concave connection part 122, there is provided a reversed insertion preventing protrusion 127 for preventing a combination error of the hanger 110 and the housing 130 that occurs between the left side unit and the right side unit during assembly of the hanger 110 and the housing 130. In addition, in the connection part 141 of the housing 130, there is provided an engagement groove 147, with which the protrusion 127 is engaged when the combination of the hanger 110 and the housing 130 is correct.

It may be possible to provide the connection part 141 and the connected part 121 between the hanger 110 and the housing 130, in such a manner as providing the connection part 141 in a concave shape and providing the connected part 121 in a convex shape, instead of providing the connection part 141 in a convex shape and providing the connected part 121 in a concave shape, and it may be also possible to change an arrangement of the convex connection part 142 and the concave connection part 122. Also, it may be possible to regulate the rotation angle of the housing 130 with respect to the hanger 110, by a structure other than fan-shaped ribs 125 and 144.

As illustrated in FIG. 6, the housing 130 is connected to the tip end of the arm part 120, with the convex connection part 142 fitted with the concave connection part 122 of the arm part 120 first, and the concave-shaped rib 144 engaged with the convex-shaped rib 125 of the arm part 120. Then, by inserting the washer 152 into the washer concave part 124 of the arm part 120, and making the male screw 150 engaged with the female screw 143 of the convex connection part 142 via the washer 152, the housing 130 is supported rotatably to the hanger 110, with the male screw 150 set as a supporting shaft. Thus, the rotation of the housing 130 is realized with a simple structure, and therefore the headphone easy to reduce in size and weight can be realized.

The housing 130 is tightened and supported by the tip end of the arm part 120 by the male screw 150 via the washer 152. Therefore, by properly adjusting a tightening torque by the male screw 150 to regulate the tightening, the housing 130 is supported rotatably to the hanger 110, with the male screw 150 set as a supporting shaft. Thus, a dispersion of a force when a screw is tightened hardly occurs during assembly, and the assembly is facilitated. Note that in order to regulate the tightening, a stepped screw may be used, instead of the male screw 150 and the washer 152.

The housing 130 is rotated with respect to the hanger 110, by sliding of the convex connection part 142 with respect to the concave connection part 122 of the arm part 120, in a state of being supported by the arm part 120 via the male screw 150. Then, the end part of the concave-shaped rib 144 in the circumferential direction is locked to the end part of the convex-shaped rib 125 in the circumferential direction, thereby regulating the rotation angle of the housing 130 with respect to the hanger 110. Thus, the rotation angle of the housing 130 with respect to the hanger 110 can be regulated with a simple structure, and therefore the headphone 100 easy to reduce in size and weight can be realized. In addition, by engagement of the fan-shaped ribs 125 and 144, the rotation angle of the housing 130 with respect to the hanger 110 is regulated, and therefore resistance strength against a rotation force can be sufficiently ensured.

Figure 7:
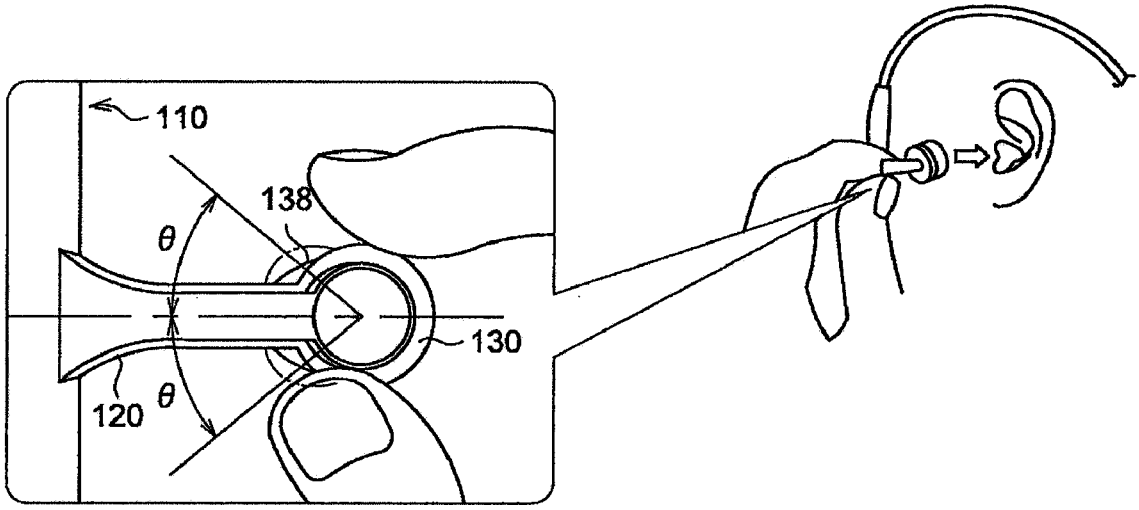
FIG. 7 is an explanatory view illustrating an adjustment method of adjusting the protruding direction of the sound guiding tube.

FIG. 7 is an explanatory view illustrating an adjustment method of adjusting the protruding direction of the sound guiding tube 136 in the headphone 100 according to this embodiment.

As illustrated in FIG. 7, the user can adjust the protruding direction of the sound guiding tube 136 having the earpiece 138 attached to the tip end, by rotating the housing 130 via the male screw 150 in a state of holding a peripheral part of the housing 130 by fingers, and by adjusting a rotation angle θ of the housing 130. Thus, by adjusting the protruding direction of the sound guiding tube 136 to obtain an excellent wearing feeling according to the inclined angle of an external auditory canal, the user can improve the wearability of the headphone 100 and can maintain the air-tightness against the external auditory canal.

Here, it is preferable to set the rotation angle θ of the housing 130, so as to be movable in the protruding direction of the sound guiding tube 136 having the earpiece 138 attached to the tip end in a range of 0° to ±40°, and particularly in a range of 0° to +40° in the elevation angle. Note that in FIG. 7, the arrangement of the earpiece 138 in a state of adjusting the protruding direction of the sound guiding tube 136 in the range of 0° to ±40° is shown by virtual line. This is a result of a sampling check performed to users, and by regulating the rotation angle θ in the above range, it is statistically confirmed that the wearability sufficiently satisfied by almost all users can be obtained.

As described above, according to the headphone 100 of this embodiment, by rotating the housing 130 with respect to the hanger 110 via the male screw 150 (supporting shaft), the protruding direction of the sound guiding tube 136 with respect to the hanger 110 can be adjusted. Thus, by adjusting the protruding direction of the sound guiding tube 136 according to the inclined angle of the external auditory canal of the user, the wearability of the headphone 100 can be improved.

In addition, by adjusting the protruding direction of the sound guiding tube 136 according to the inclined angle of the external auditory canal, the air-tightness against the external auditory canal can be improved, and sound leakage prevention to the surrounding area and acoustic characteristics can be improved. Particularly, in the case of the headphone 100 having the driver unit 132 of low output, fluctuation of the acoustic characteristics is great, and therefore the acoustic characteristics can be remarkably improved.

MODIFIED EXAMPLE

Description will be given hereunder, for a modified example in which the present invention is applied to a headband type headphone 200 which is passed over the head top part.

Figure 8:
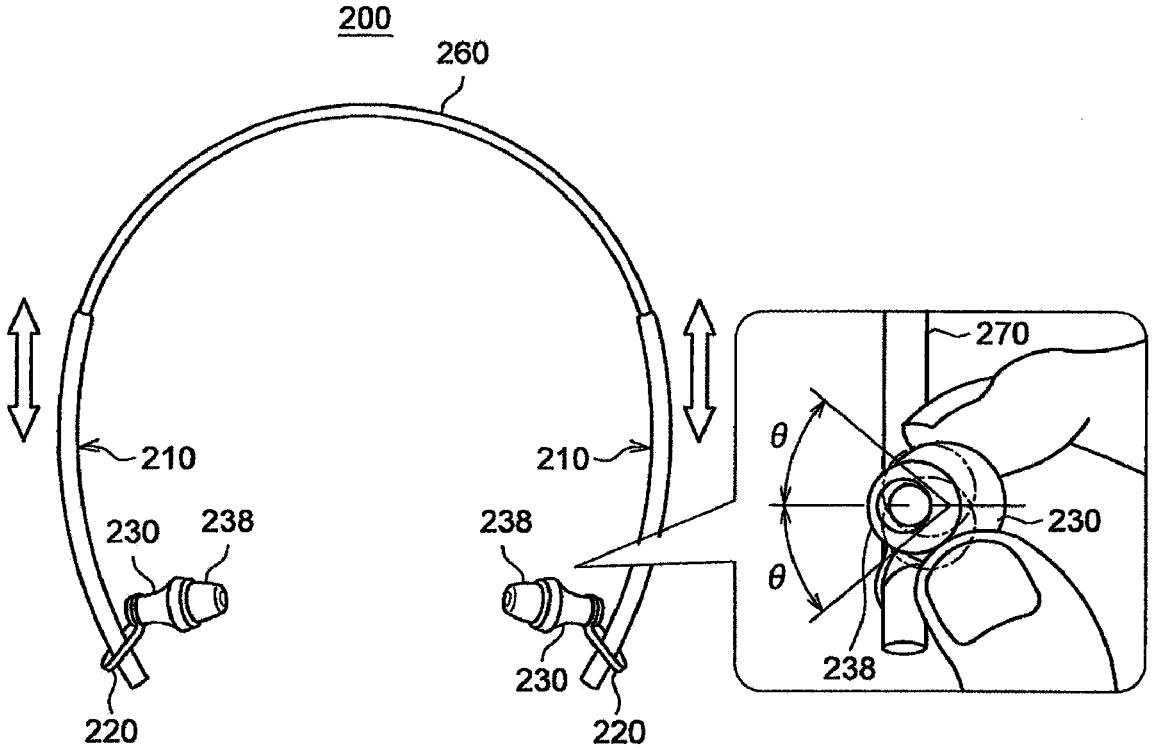
FIG. 8 is an explanatory view illustrating the adjustment method of adjusting the protruding direction of the sound guiding tube.

FIG. 8 is an explanatory view illustrating the adjustment method of adjusting the protruding direction of the sound guiding tube in the headphone 200 according to this modified example. As illustrated in FIG. 8, the headphone 200 is constituted of a pair of units, and a headband 260 having the pair of units attached to both ends. Each of the units has a cylindrical slider 210 (also called a hanger), and an approximately U-shaped headband 260 curved along the head top part of the user is attached to the upper end of the sliders 210.

The headband 260 has flexibility and a linear distance between both ends can be adjusted in a predetermined range. One end of the slider 210 can be slidably attached to the end part of the headband 260. In the slider 210, a housing 230 is attached to the tip end of an arm part 220, and an elastic earpiece 238 is attached to the tip end of the sound guiding tube (not shown) protruded from the housing 230 in a predetermined direction. The housing 230 is supported rotatably to the tip end of the arm part 220 via the supporting shaft (not shown).

The user can adjust a sliding amount of the slider 210 with respect to the headband 200, so that right and left housings 230 are positioned at approximately the front side of the right and left auricles, respectively, according to the shapes and sizes of the self-top part and the auricle.

Here, the headphone 200 according to this modified example has an adjustment mechanism for adjusting the protruding direction of the sound guiding tube, in the same way as the headphone 100 according to the above embodiment. Note that a functional structure and an action effect of this adjustment mechanism are the same as the case of the headphone 100 according to the above embodiment, and therefore explanation therefore is omitted.

The user can adjust a sliding amount of the slider 210 with respect to the headband 260. In addition, as illustrated in FIG. 8, the user can adjust the protruding direction of the sound guiding tube having the earpiece 238 attached to the tip end, by rotating the housing 230 via the supporting shaft in a state of holding the peripheral part of the housing 230 by fingers and by adjusting the rotation angle θ of the housing 230.

Thus, by adjusting the protruding direction of the sound guiding tube to obtain the excellent wearing feeling according to the inclined angle of the self-external auditory canal, the wearability of the headphone 200 can be improved and the air-tightness against the external auditory canal can be maintained.

Although a preferred embodiment of the present invention is described in the foregoing with reference to the drawings, the present invention is not limited thereto. It should be understood by those skilled in the art that various modifications, combinations, sub-combinations and alterations may occur depending on design requirements and other factors insofar as they are within the scope of the appended claims or the equivalents thereof.

What is claimed is:

1. A headphone, comprising:

a housing that contains a driver unit;

a sound guiding tube that protrudes from the housing in a predetermined direction, and guides a sound generated from the driver unit to an external auditory canal; and a hanger that rotatably supports the housing, via a supporting shaft provided in approximately the same direction as a depth direction of the external auditory canal and in an inclined direction with respect to a protruding direction of the sound guiding tube, the hanger formed into an approximately T-shape, wherein the hanger further includes a protrusion for preventing a combination error of the hanger and the housing, and the housing further includes an engagement groove, the engagement groove and the protrusion being engaged when the combination of the hanger and the housing is correct, wherein a rotation angle of the housing with respect to the hanger is regulated via ribs, provided to the housing and the hanger.

2. The headphone according to claim 1, further comprising:

an earpiece attached to a tip end of the sound guiding tube.

3. The headphone according to claim 1, wherein the housing is supported rotatably to the hanger via the supporting shaft, so as to be movable in a protruding direction of the sound guiding tube in a range of 0° to ±40°, with a horizontal surface set as a reference when the headphone is worn.

4. The headphone according to claim 3, wherein the housing is supported rotatably to the hanger via the supporting shaft, so as to be movable in the protruding direction of the sound guiding tube in a range of 0° to 40° in an elevation angle, with the horizontal surface set as a reference when the headphone is worn.

5. The headphone according to claim 1, wherein the supporting shaft is a screw member.

6. A headphone, comprising:

a housing that contains a driver unit and a first rib;

a sound guiding tube that protrudes from the housing in a predetermined direction, and guides a sound generated from the driver unit to an external auditory canal; and a hanger that rotatably supports the housing, via a supporting shaft provided in approximately the same direction as a depth direction of the external auditory canal and in an inclined direction with respect to a protruding direction of the sound guiding tube, the hanger further including an arm part having a second rib configured to regulate a rotation angle of the housing with respect to the hanger by engaging with the first rib, wherein the hanger further includes a protrusion for preventing a combination error of the hanger and the housing, and the housing further includes an engagement groove, the engagement groove and the protrusion being engaged when the combination of the hanger and the housing is correct, and wherein the second rib is disposed between a first end surface and a second end surface of the first rib.

7. A headphone, comprising:

a housing that contains a driver unit, a first rib, and an engagement groove;

a sound guiding tube that protrudes from the housing in a predetermined direction, and guides a sound generated from the driver unit to an external auditory canal; and a hanger that rotatably supports the housing, via a supporting shaft provided in approximately the same direction as a depth direction of the external auditory canal and in an inclined direction with respect to a protruding direction of the sound guiding tube, the hanger formed into an approximately T-shape and further including:

an arm part having a second rib configured to regulate a rotation angle of the housing with respect to the hanger by engaging with the first rib, wherein the second rib is disposed between a first end surface and a second end surface of the first rib; and a protrusion for preventing a combination error of the hanger and the housing, wherein the protrusion and the engagement groove are engaged when the combination of the hanger and the housing is correct.

* * * * *